US005116232A

United States Patent [19]

Follett

[11] Patent Number: 5,116,232

[45] Date of Patent: May 26, 1992

[54] DOUBLE PLUG ASSEMBLY

[76] Inventor: Brad Follett, Box 256, Site 2, R.R. 7, Calgary, Alberta, Canada, T2P 2G7

[21] Appl. No.: 716,552

[22] Filed: Jun. 17, 1991

[51] Int. Cl.[5] ..... H01R 29/00

[52] U.S. Cl. ..... 439/107; 200/51 R; 439/221; 439/490

[58] Field of Search ..... 439/92, 101, 105, 106, 439/107, 166, 170, 218, 221, 222, 52, 53, 490; 200/51 R, 51.03-51.07

[56] References Cited

U.S. PATENT DOCUMENTS

| | | | |
|---|---|---|---|
| 3,943,310 | 3/1976 | Gertz | 200/51 R |
| 4,019,797 | 4/1977 | Praml | 439/222 |
| 4,606,597 | 8/1986 | Bielefeld | 439/490 |

*Primary Examiner*—Neil Abrams
*Attorney, Agent, or Firm*—George H. Dunsmuir

[57] ABSTRACT

A wall plug for use with a split circuit duplex wall outlet, including an indicator light to identify the split circuit and including switch means for selectively operating the wall plug on one or both of these two household circuits available at a standard outlet.

2 Claims, 2 Drawing Sheets

DOUBLE PLUG ASSEMBLY

BACKGROUND OF THE INVENTION

This invention relates to an improved electrical appliance wall plug for use with a split circuit duplex wall outlet.

Commonly found in residential kitchens, the split circuit duplex outlet provides power for up to two separate appliances which consume relatively large amounts of power, such as deep fryers, electric kettles, griddles, broilers and ovens, each having power requirements of up to 1500 watts.

Conventionally, kitchen appliances are designed for use with single circuit 115 volt alternating current outlets, and utilize a single 2 or 3 pronged male plug and a 2 or 3 wire power cord. Certain appliances, such as those mentioned above, can under perform at wattages limited, conventionally, to 1500 watts and may benefit substantially in their operation by an increase in power to between 1500 and 3000 watts. Current building codes require all kitchen counter outlets to be split circuit duplex wall receptacles providing two 1500 watt circuits operating at the same frequency but 180 degrees out-of-phase, which can accommodate plugs having 6 male prongs comprising 2 sets of 3 prongs, namely a "hot" or power lead (normally red or black), a neutral (white), and a ground (green), and thereby supply up to two 1500 watt 115 volt circuits (3000 watts) or one 3000 watt 230 volt circuit to a single specifically designed appliance.

Need has existed arising from the requirement for flexibility in outlet voltages for either 115 or 230 volts, without altering the household wiring connected to the split circuit duplex wall outlet, and to accommodate this need, prior art teachings, such as United States patent to Praml, 4,019,797 dated Apr. 16, 1977, have described plugs comprising two halves in a duplex wall plug which may operate to provide either standard 115 volt or 230 volt power, by substituting plugs having appropriate electrical connections.

One of the improvements comprised in the present invention involves the incorporation of a split circuit indicator light, which visually distinguishes between single and split circuit household duplex receptacles which are unidentifiable otherwise.

Another improvement involves the incorporation of switch means in the plug operating to selectively utilize either both or one side only of a split circuit power supply, thereby allowing the user the flexibility of access to 3000 watts or 1500 watts of power from a split circuit outlet. Further to this, the switch can also limit power to 1500 watts from a single circuit outlet found in kitchens wired prior to the current building codes.

BRIEF DESCRIPTION OF THE INVENTION

Accordingly, it is the principle objective of this invention to provide a plug assembly including visual indication means, such as an indicator light, to distinguish between split circuit and single circuit kitchen duplex outlets.

It is another objective of this invention to provide a plug assembly for use in combination with (1) an identified split circuit duplex outlet having switch means to selectively configure the plug for low power single circuit operation or high power plug configurations and (2) an identified single circuit duplex outlet having switch means to selectively configure the plug to limit it to single circuit operation.

It is a further object of the invention to provide an apparatus of the type described, which is characterized by a simplicity of design and possesses the necessary ruggedness for practical and reliable use.

Additional objects and advantages will become apparent from the following detailed description taken in conjunction with the accompanying drawings and appended claims in which:

BRIEF DESCRIPTION OF THE DRAWINGS

Similar numerals of reference designate corresponding parts in the drawings.

DESCRIPTION OF THE PREFERRED EMBODIMENTS

Figure 1:
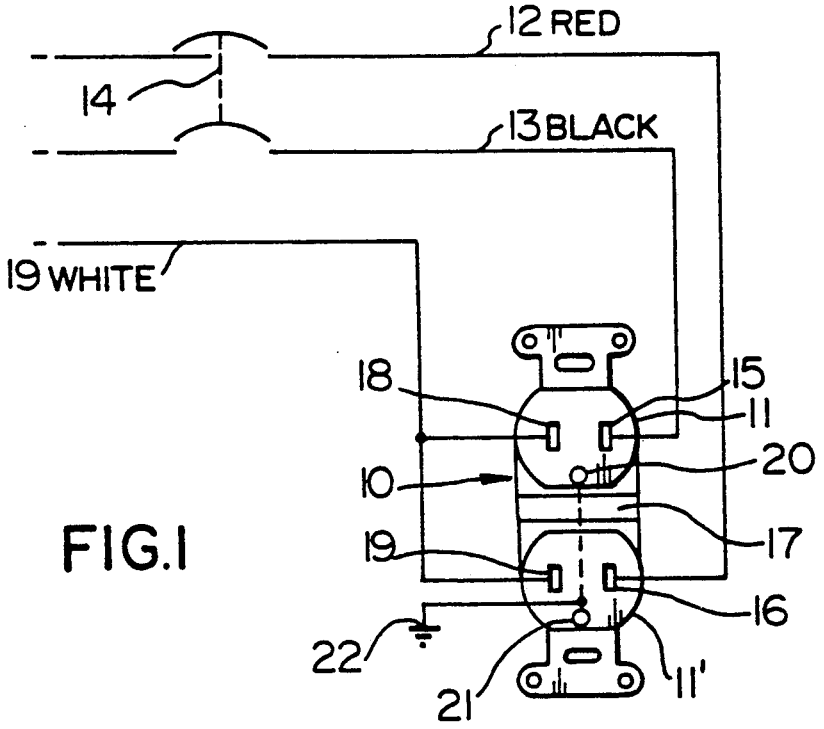
FIG. 1 is a schematic of a split wire circuit of a type in common use in residences for connection to duplex wall outlets.

Referring to the drawings and with particular reference to FIG. 1, a schematic showing of a split wire circuit of a type conventionally available in modern residential construction is depicted, in which a grounded duplex electrical outlet 10, comprising a pair of outlets 11 and 11 , to which are connected, respectively, hot leads 12 and 13 designated respectively as "red" and "black", and connected to the power supply panel through a single throw 230 volt breaker 14. Female connectors 15 and 16 are positioned in the insulated housing 17 at opposite ends, as depicted in FIG. 1 to which the hot leads 12 and 13 are connected. Neutral connectors 18 and 19 are spacially aligned conventionally with hot wire connectors 15 and 16 and are connected in parallel to a neutral lead 19, designated "white" in FIG. 1. Grounding connectors 20 and 21 centered on the housing 17, are electrically connected to ground 22, FIG. 1.

Figure 2:
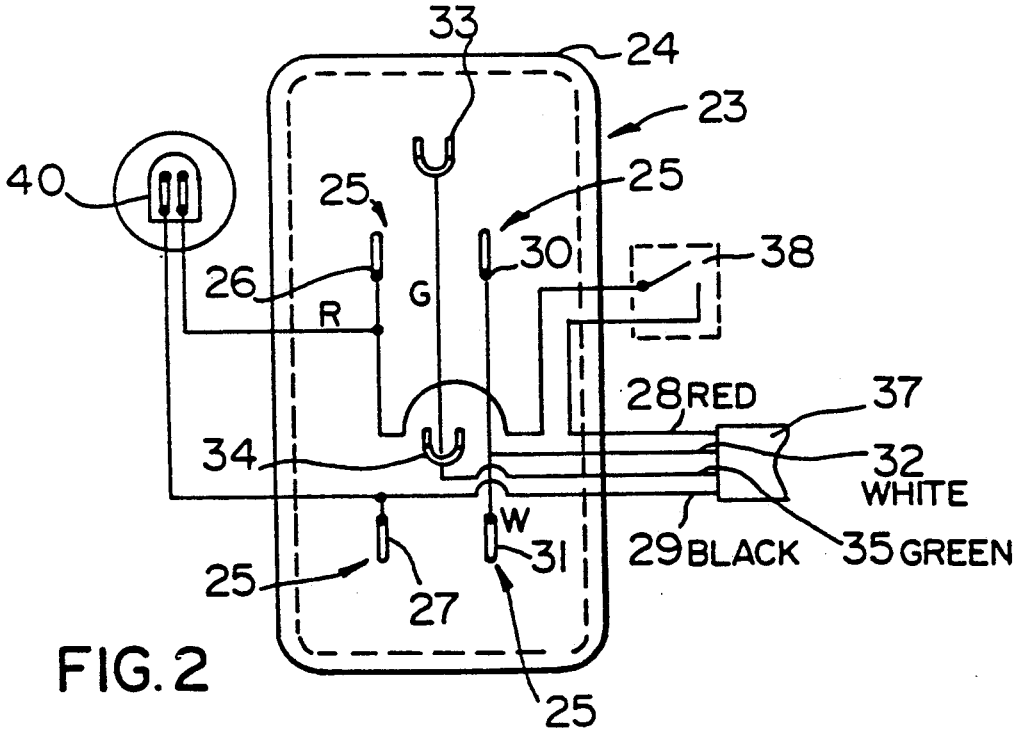
FIG. 2 is a plan view, partly in schematic, of a plug assembly in accordance with the preferred embodiment of the present invention.

Referring to FIG. 2, a preferred embodiment of the plug assembly of the invention is depicted, adapted to terminate the electrical cords from electrical appliances or other load-bearing devices. The plug assembly generally designed 23 comprises an insulated housing 24 of non-conductive plastic, preferably of a phenolic resin conforming to Underwriters' Laboratories Inc. specifications for 230 volts. The molded housing 24 is of generally rectangular box-like hollow configuration, constituted to hold the electrically operative elements in rigid configuration, and can be either two-part construction or unitary. Prongs or blades generally indicated at 25 project from the face of the housing 24, as indicated in FIG. 3, to register with the connectors of the outlet 10, FIG. 1, as will now be described.

Referring again to FIG. 2, the prong 25 includes power prongs 26 and 27 are aligned on the face of the housing 24 with the hot connectors 15 and 16 respectively of FIG. 1, and not leads 28 and 29, designated "red" and "black", FIG. 2, connect electrically with the power prongs 26 and 27.

Neutral prongs 30 and 31 are similarly aligned on the housing 24 to register with neutral connectors 18 and 19, FIG. 1, and are electrically connected to a common neutral lead 32, designated "white", FIG. 2. Ground prongs 33, 34, normally of u-ground type, are positioned centrally of the housing 24, and aligned with ground connectors 20 and 21, FIG. 1, and are electrically connected to the common ground wire 35, designated "green", FIG. 2.

Figure 3:
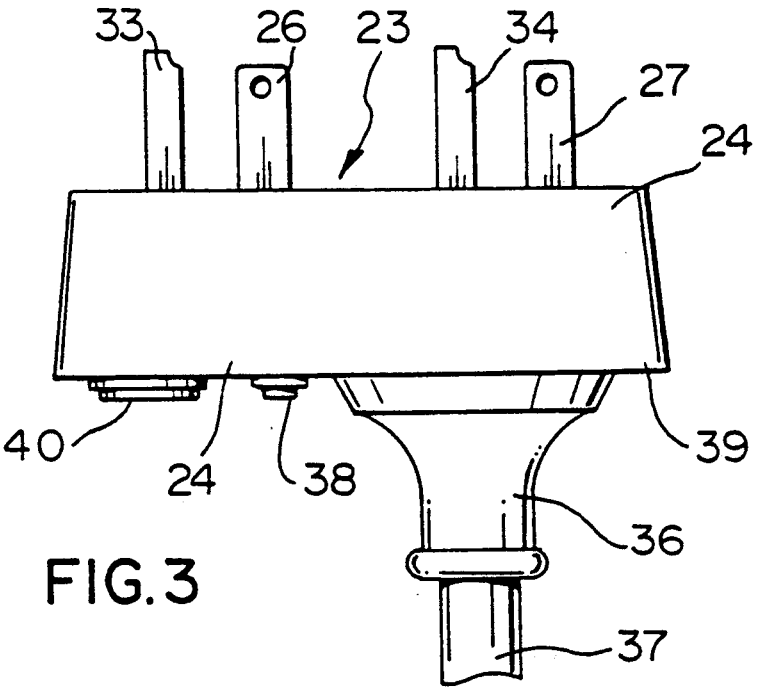
FIG. 3 is a side view of the plug assembly of FIG. 2.
Figure 4:
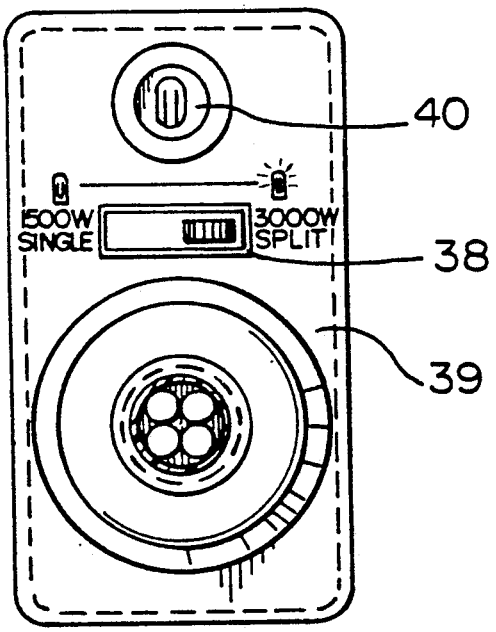
FIG. 4 is a plan view depicting the housing of the plug assembly of FIG. 2.

The prongs or blades 25 are normally formed of brass or other conducting metal, and extend through the face of the housing 24, into the housing interior and employ conventional electrical connecting means such as screw terminals (not illustrated) for connection of the electrical leads 28, 29, 32, and 35 passing outwardly of the housing 24 at the insulating nipple 36 projecting from the rear surface of the housing 24, FIG. 3, and are normally enclosed within a common conduit or cable 37, leading to the load-bearing appliance.

Referring further to FIGS. 2 and 3, a switch 38 is included on one of the power leads 28, 29, selectively to open one of the circuits, the second circuit remaining closed, as depicted in FIG. 2. Switch 38 desirably of the slide or throw type, is depicted mounted rigidly on the back surface 39 of the housing 24.

Further reference to FIGS. 2 and 3 discloses an indicator light 40, electrically connected across the hot connectors 25 and 26, FIG. 2, and will be similarly mounted rigidly on the back surface 39 of the housing 24, FIG. 3. The indicator light will accommodate 250 volts, as the maximum voltage potential between two halves of the split voltage supplied to the plug assembly.

In operation:

(1) with the plug inserted into a split circuit outlet the indicator light 40 will respond to visually indicate that a split circuit outlet has been utilized and two 15 amp circuits are available for use. With the switch 38 closed both 15 amp circuits are available for use as a high power setting and with the switch 38 open only one 15 amp circuit is available for use as a low power setting.

(2) with the plug inserted into a single circuit outlet the indicator light 40 will not respond and indicate that a single circuit outlet has been utilized and only one 15 amp circuit is available for use. This limits the switch 38 to the open position only, providing for use in the low power setting exclusively.

The foregoing system offers the following advantages.

(1) a plug assembly for use in combination with a duplex outlet with an indicator light that visually identifies whether a split circuit or single circuit outlet has been utilized and whether both nigh and low power settings are available, and (2) a switch to allow both high and low power settings when used in combination with a split circuit outlet and to allow usage in the low power setting only, when used in combination with a single circuit outlet.

The present invention is not limited to the specific embodiment disclosed by way of example. It will be appreciated that a plug of the disclosed embodiment can be used with split wire direct current circuits, as well as the alternating current circuit shown herein. It will be understood that the scope of the invention is only limited as defined in the appended claims.

What I claim is:

1. A plug assembly for use in combination with a duplex outlet wired as a single circuit or split circuit having a first pair of connectors at a certain voltage potential and a second pair of connectors at a neutral potential, said plug assembly comprising:

a) a housing;

b) a first pair of prong connectors extending outwardly from aid housing and adapted to register with the first pair of connectors in the duplex receptacle;

c) a second pair of prong connectors extending outwardly from said housing and adapted to register with the second pair of connectors in the duplex receptacle;

d) first connection means for connecting to one of said first pair of prong connectors;

e) second connection means for connecting to the other of said first pair of prong connectors;

f) third connection means for connecting to said second pair of prong connectors;

g) indicator means connected across each of said first pair of prong connectors for indicating a voltage potential therebetween, thereby indicating whether the first pair of connectors in the duplex receptacle is connected to said split circuit; and h) switch means disposed in one of said first and second connection means having on and off positions for selectively switching said one of said first and second connection means in one of said one and off positions, thereby providing a higher power output when said switch means is in said on position than in said off position to selectively choose between said single and split circuits.

2. A plug assembly as in claim 1 wherein:

a) said indicating means includes a light.

* * * * *